US011506400B2

(12) United States Patent
Xu et al.

(10) Patent No.: US 11,506,400 B2
(45) Date of Patent: Nov. 22, 2022

(54) PANEL MECHANISM OF A RANGE HOOD

(71) Applicant: Ningbo Fotile Kitchen Ware Co., Ltd., Ningbo (CN)

(72) Inventors: Zhineng Xu, Ningbo (CN); Ting Yu, Ningbo (CN)

(73) Assignee: Ningbo Fotile Kitchen Ware Co., Ltd., Ningbo (CN)

( * ) Notice: Subject to any disclaimer, the term of this patent is extended or adjusted under 35 U.S.C. 154(b) by 206 days.

(21) Appl. No.: 17/250,032

(22) PCT Filed: Mar. 13, 2019

(86) PCT No.: PCT/CN2019/077987
§ 371 (c)(1),
(2) Date: Nov. 9, 2020

(87) PCT Pub. No.: WO2019/223404
PCT Pub. Date: Nov. 28, 2019

(65) Prior Publication Data

US 2021/0239325 A1 Aug. 5, 2021

(30) Foreign Application Priority Data

May 24, 2018 (CN) ..... 201820787997.3

(51) Int. Cl.
*F24C 15/20* (2006.01)

(52) U.S. Cl.
CPC ..... *F24C 15/20* (2013.01)

(58) Field of Classification Search
USPC ..... 454/56; 126/299 R
See application file for complete search history.

(56) References Cited

FOREIGN PATENT DOCUMENTS

CN 104373985 A * 2/2015 ..... F24C 15/20

* cited by examiner

*Primary Examiner* — Ko-Wei Lin
(74) *Attorney, Agent, or Firm* — Wang Law Firm, Inc.

(57) ABSTRACT

The present invention discloses a panel mechanism of a range hood. The range hood comprises a left side plate (3), a right side plate (4), and a plurality of hanging pieces (5); the panel mechanism comprising a panel (1) and a panel frame (2), the panel frame (2) comprises a center plate (20), a left hanging bar (21), a right hanging bar (22) and a support bar (26), the left hanging bar (21) and the right hanging bar (22) has a plurality of hanging slots (23,24), each hanging slot (23,24) engages one hanging piece (5); the first hanging slot (23) is bent backward from the top to the down; and the second hanging slot (24) is sloped backward from the top to the down; the opening of each of the first hanging slot (23) and the second hanging slot (24) is bigger than the inner end of the first hanging slot (23) and the second hanging slot (24), enabling the first hanging slot (23) and the second hanging slot (24) to be hung on the corresponding hanging pieces (5) more easily. Therefore, it is easy for assembly and disassembly.

5 Claims, 9 Drawing Sheets

PANEL MECHANISM OF A RANGE HOOD

TECHNICAL FIELD OF THE INVENTION

The present invention relates to the technical field of range hoods, and in particular to a panel mechanism of a range hood.

BACKGROUND OF THE INVENTION

Generally, a panel of a range hood is fixed to left and right side plates thereof, thereby shielding an inner cavity of the range hood to make the inner cavity serve as an exhaust fume collecting cavity. For example, a close-suction range hood disclosed in Chinese Patent CN104329708A (Patent No. ZL201410537477.3) comprises a machine body, an exhaust fume collecting hood and a fan, and a panel and an oil filter screen are mounted on the exhaust fume collecting hood. After long-term use, oil will be inevitably accumulated in the inner cavity of the range hood. When it is necessary to clean up the oil accumulated in the inner cavity of the existing range hood, the panel needs to be removed from the range hood by a professional to expose the inner cavity of the range hood, thus exposing the main oil area in the inner cavity, only then can the oil accumulated in the inner cavity of the range hood be cleaned up.

From the above, it is troublesome to disassemble and assemble the panel of the existing range hood, making it troublesome to clean up the oil accumulated in the inner cavity of the range hood.

SUMMARY OF THE INVENTION

It is an object of the present invention to provide a panel mechanism of a range hood which is easy for disassembly and assembly.

For achieving the above object, the panel mechanism of the range hood, the range hood comprises: a left side plate; a right side plate; and a plurality of hanging pieces disposed on the left and right side plates; the panel mechanism comprises a panel having an inner side surface and a panel frame attached to the inner side surface of the panel; wherein, the panel frame has a plurality of hanging slots disposed at a left end and a right end of the panel frame, each hanging slot engages one hanging piece and the panel frame is secured by the plurality of hanging pieces; the panel frame has two fixing holes respectively disposed at the left end and right end of the panel frame, and two fasteners respectively pass through each fixing hole to fix the panel frame to the left and right side plates of the range hood.

Preferably, the panel frame has a left hanging bar and a right hanging bar which are vertical relative to the inner side surface of the panel, and distributed along the width direction of the panel, the plurality of hanging slots are distributed on the left hanging bar and the right hanging bar, thus facilitating the hanging slots to be hung on the corresponding hanging pieces.

Preferably, each hanging bar has an upper portion and a lower portion, the hanging slots on each hanging bar comprises a first hanging slot located on the upper portion of the hanging bar and a second hanging slot located on the lower portion of the hanging bar, and each hanging slot engages to the corresponding hanging piece; each hanging slot has a downward opening. The first hanging slot and the second hanging slot are arranged up and down, so that the panel mechanism can be firmly hung on an enclosure. Each hanging slot opens downward, so as to facilitate the hanging slots to be hung on the corresponding hanging pieces.

Preferably, the first hanging slot, having a bent passage, is bent backward from the top to the down, and the opening of the first hanging slot is located on a rear edge of the hanging bar; and the second hanging slot, having a sloped passage, is sloped backward from the top to the down, and the opening of the second hanging slot is located on a bottom edge of the hanging bar. During assembly of the panel mechanism, it is easy to first hang the second hanging slot on the corresponding hanging piece, and then hang the first hanging slot on the corresponding hanging piece. Moreover, the first hanging slot can limit the panel mechanism up and down to a certain extent through its bent passage, so that the panel mechanism can be limited in more excellent manner through the hanging slots and the hanging pieces.

Preferably, the opening of each of the first hanging slot and the second hanging slot is bigger than the inner end of the first hanging slot and the second hanging slot, enabling the first hanging slot and the second hanging slot to be hung on the corresponding hanging pieces more easily.

Preferably, each of the fixing holes is arranged on the upper portion of each hanging bar, and located above the corresponding first hanging slot, and spaced away from the first hanging slot, so that mutual interference between the fasteners and the corresponding hanging pieces can be avoided, and the panel mechanism can be fixed more firmly to the enclosure of the range hood.

Preferably, the hanging pieces are stepped screws fixed on the left and right side plates respectively, which can make the hanging pieces simple in structure and also can limit the panel mechanism in more excellent manner through the hanging slots.

Compared with the prior art, the present invention has the following advantages:

The panel frame has a plurality of hanging slots disposed at a left end and a right end of the panel frame, each hanging slot engages one hanging piece fixed on the left and right side plates and the panel frame is secured by the plurality of hanging pieces, the panel frame has two fixing holes respectively disposed at the left end and right end of the panel frame, and two fasteners respectively pass through each fixing hole to fix the panel frame to the left and right side plates of the range hood.

During the mounting of the panel mechanism, the panel and the panel frame is hung on the housing of the range hood through the hanging slots and the hanging pieces, and the panel and the panel frame then is fixed on the housing by the fasteners;

During the disassembly of the panel mechanism, the panel mechanism can be removed from the hanging pieces by simply unscrewing the fasteners, therefore it is easy for disassembly. When it is necessary to clean up the oil accumulated in the inner cavity of the range hood, the panel mechanism can be easily removed to expose the oil accumulated area to be cleaned up in the range hood, so as to make it easy for users to clean up the oil accumulated in the range hood.

DETAILED DESCRIPTION OF THE INVENTION

The present invention will be further described below in detail by embodiments with reference to the accompanying drawings.

Figure 1:
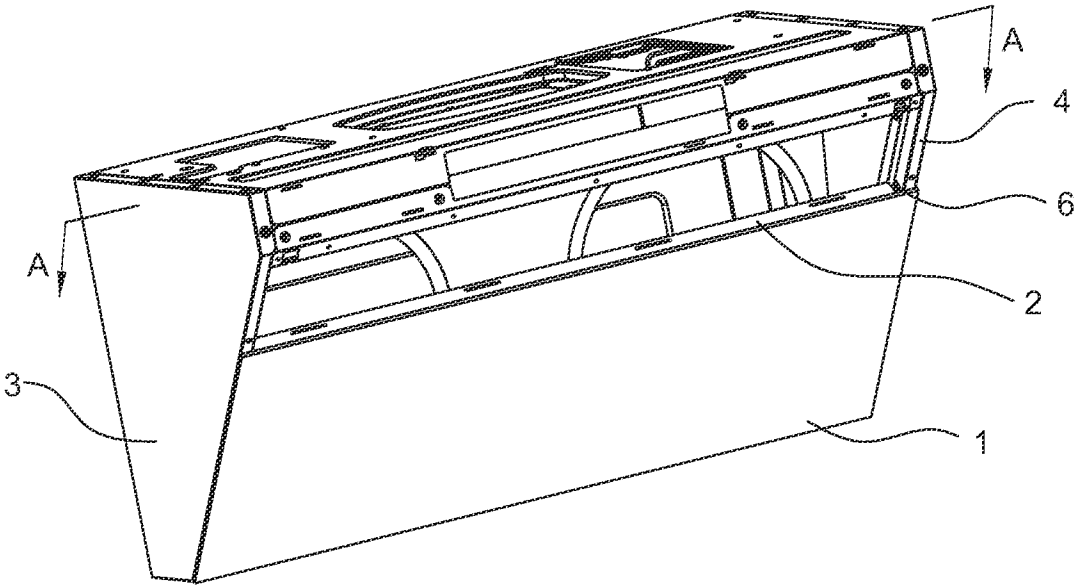
FIG. 1 is a perspective view of a range hood with a panel mechanism according to an embodiment of the present invention.
Figure 2:
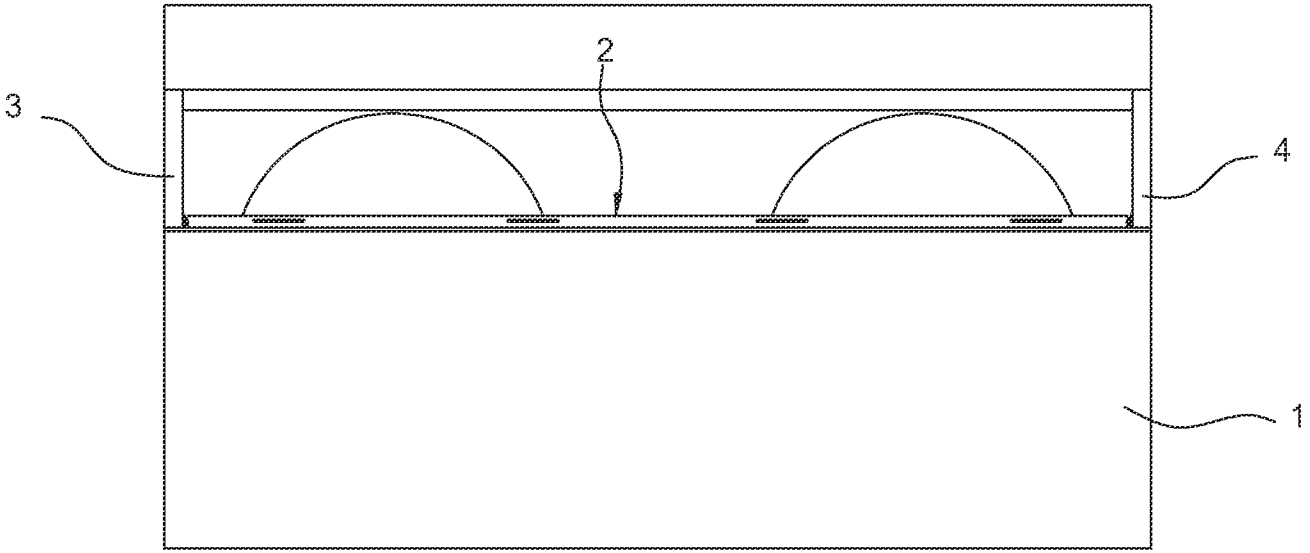
FIG. 2 is a front view of FIG. 1 (a simplified showing of partial components of the range hood)
Figure 3:
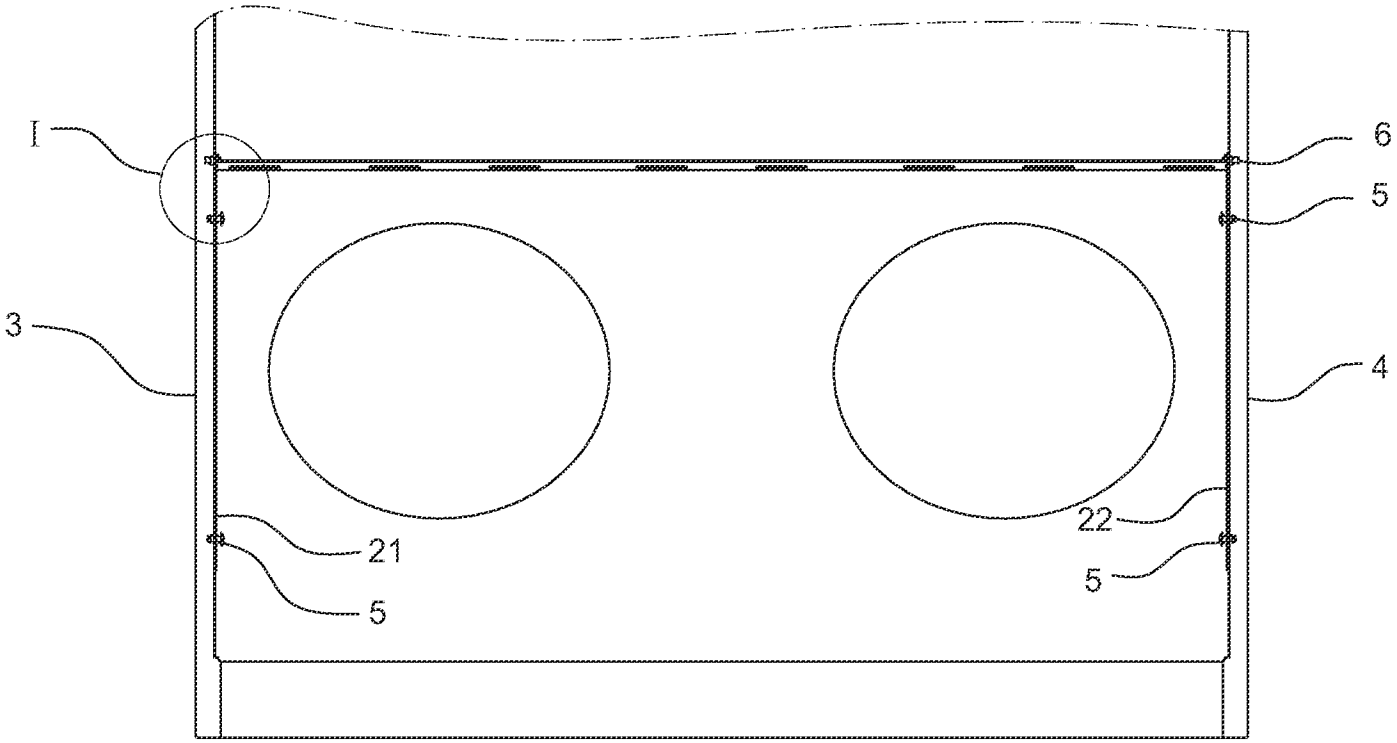
FIG. 3 is a sectional view of FIG. 1 in a direction A-A (right down to hanging pieces and fasteners, with partial components omitted)
Figure 4:
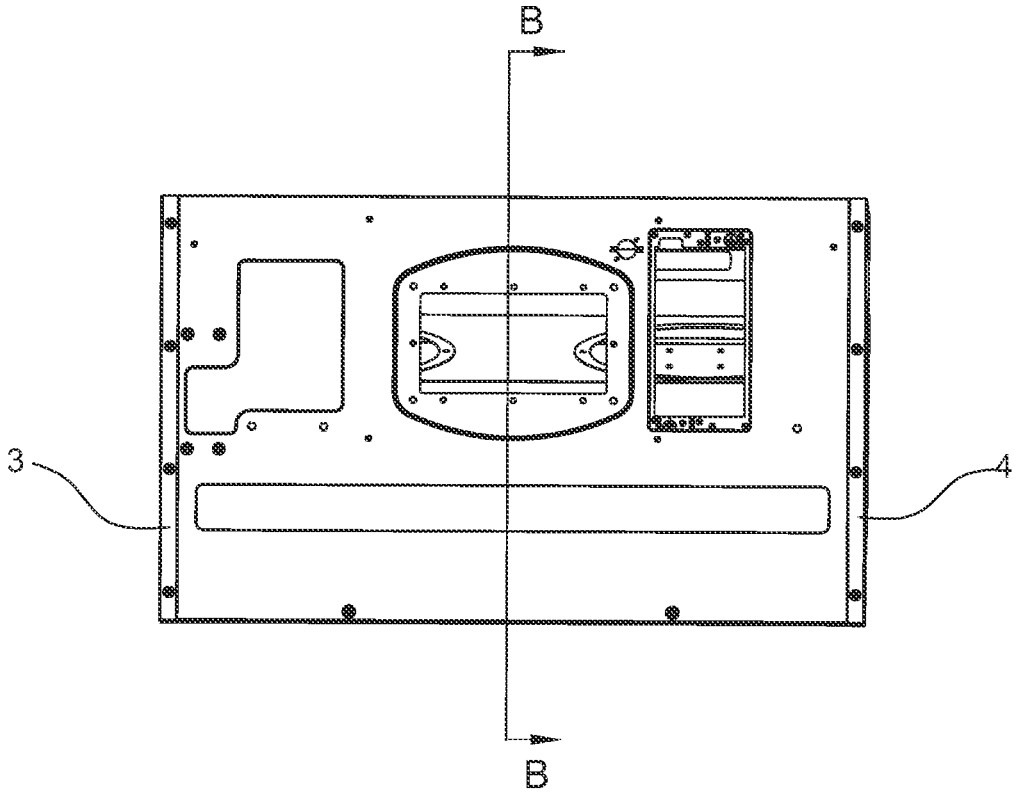
FIG. 4 is a top view of FIG. 1.
Figure 5:
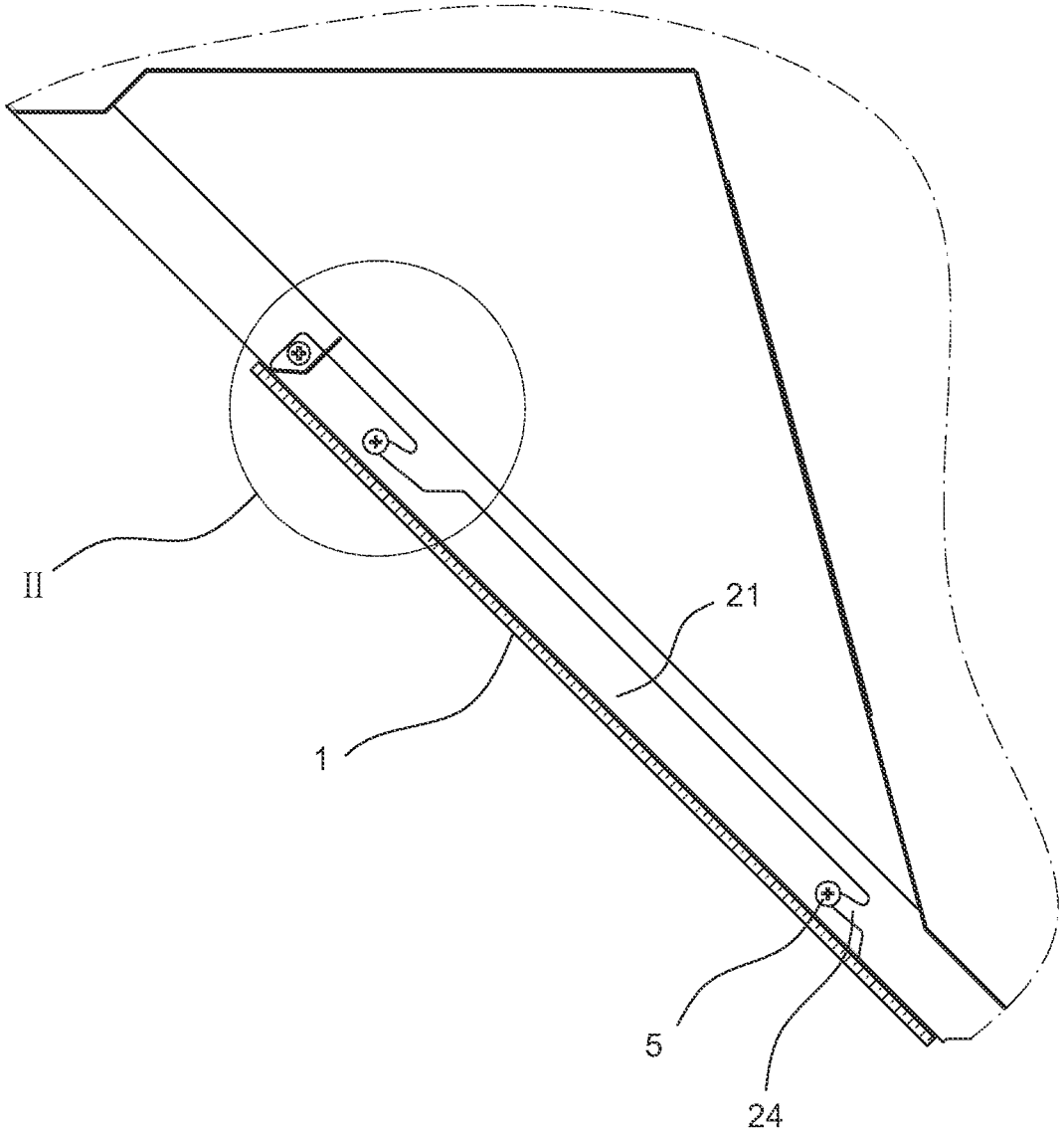
FIG. 5 is a sectional view of FIG. 4 in a direction B-B (with partial components omitted)
Figure 6:
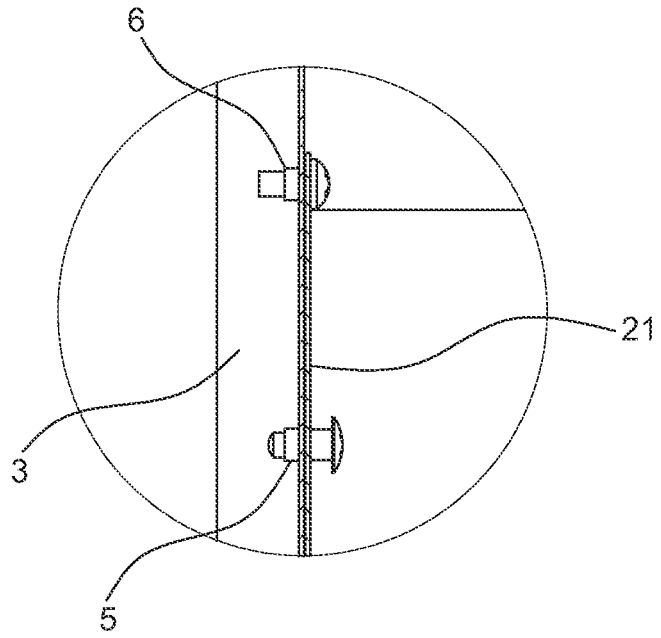
FIG. 6 is an enlarged view of a part-I in FIG. 3.
Figure 7:
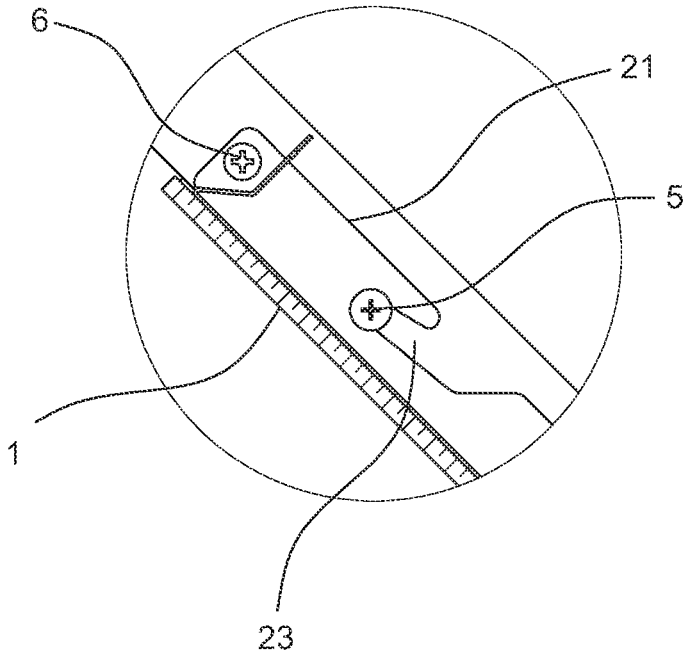
FIG. 7 is an enlarged view of a Part-II in FIG. 4.
Figure 8:
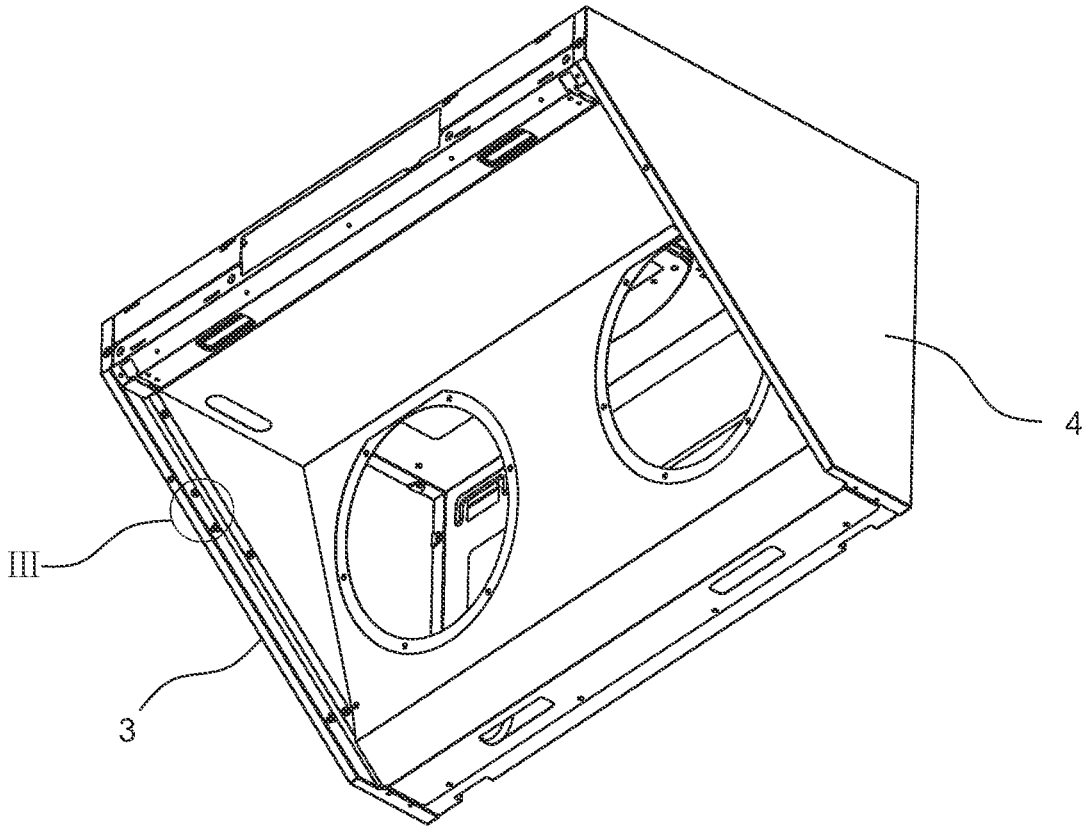
FIG. 8 is a perspective view of the range hood with the panel and the panel frame removed according to the embodiment of the present invention.
Figure 9:
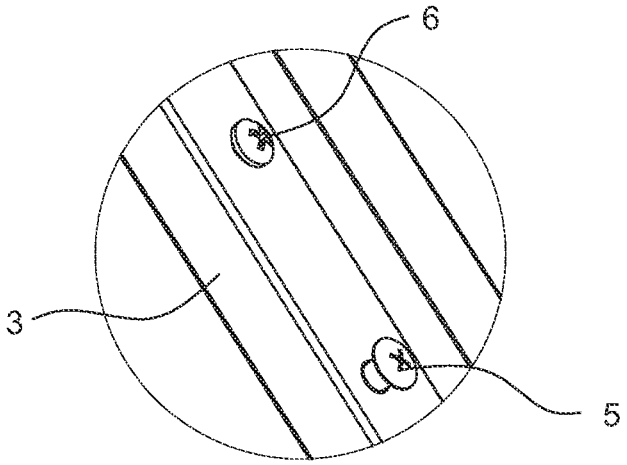
FIG. 9 is an enlarged view of a Part-III in FIG. 8.
Figure 10:
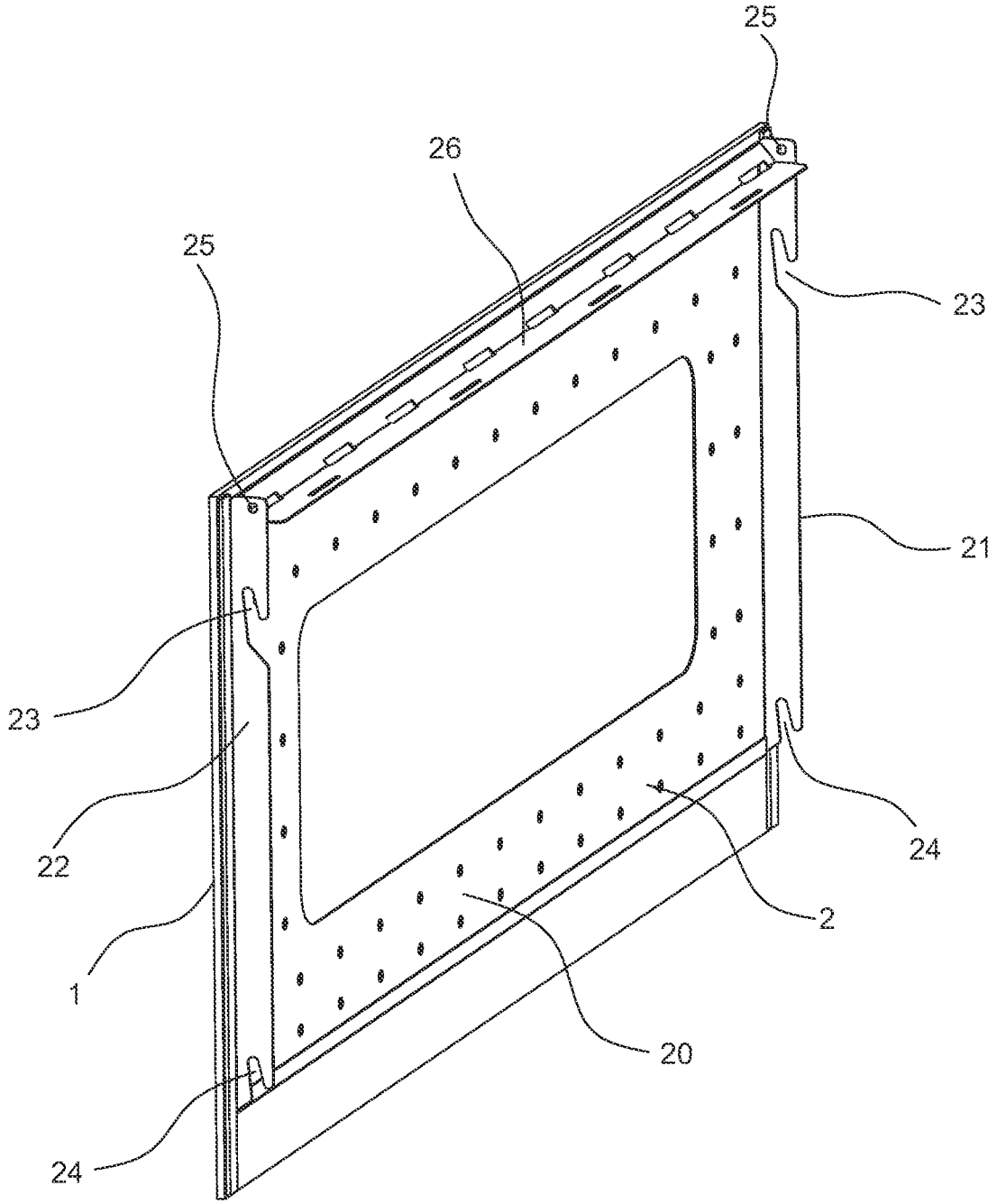
FIG. 10 is a perspective view of the panel mechanism according to the embodiment of the present invention.
Figure 11:
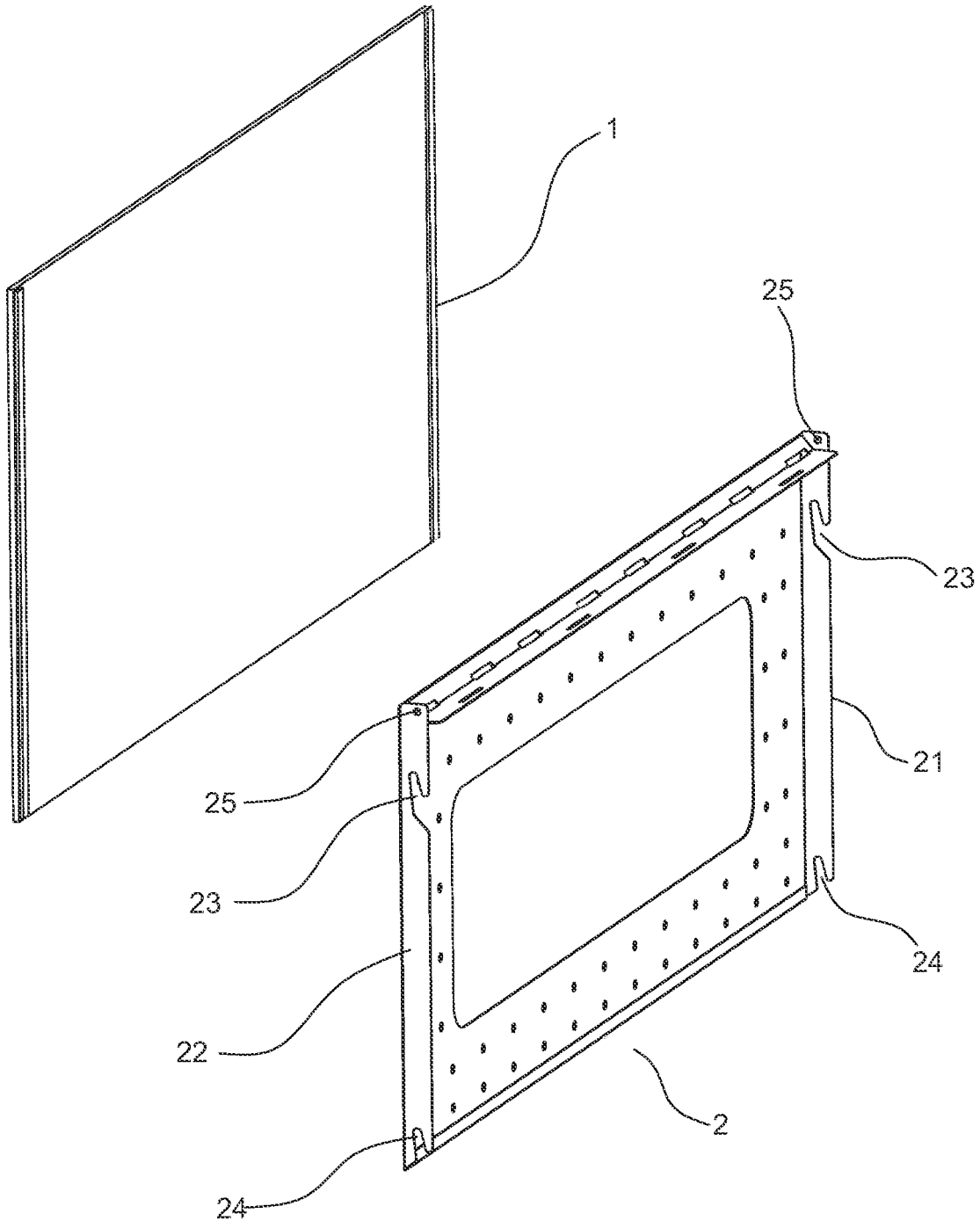
FIG. 11 is an exploded view of the panel mechanism according to the embodiment of the present invention.

FIGS. 1-11 show a range hood with a panel mechanism according to an embodiment of the present invention. The range hood comprises a left side plate 3, a right side plate 4, a plurality of hanging pieces 5 disposed on the left and right side plates 3 and 4, and a panel mechanism disposed between the left and right side plates 3 and 4.

The panel mechanism comprises a panel 1 having an inner side surface and a panel frame 2 attached to the inner side surface of the panel 1.

The panel frame 2 comprises a center plate 20 located at the middle of the panel frame 2, a left hanging bar 21, a right hanging bar 22 and a support bar 26. The left and right hanging bars 21 and 22 are located on left and right sides of the center plate 20 and at left and right ends of an inner side surface of the panel 1, respectively, and the support bar 26 is located at an upper end of the center plate 20 for supporting a smoke baffle (not shown) of the range hood.

In this embodiment, the panel frame 2 is an integral piece, and the left hanging bar 21, the right hanging bar 22 and the support bar 26 are respectively formed by bending corresponding side edges of the center plate 20 backward with respect to the panel 1, and the left and right hanging bars 21 and 22 are perpendicular to the inner side surface of the panel 1 and extend in the width direction of the panel 1, respectively.

A plurality of hanging slots are respectively disposed on each hanging bar, and the hanging pieces 5 are mounted on inner side surface of the left and right side plates 3 and 4 respectively, and each hanging slot engages one hanging piece 5. Specifically, each hanging bar 21 and 22 has an upper portion and a lower portion, the hanging slots 23 and 24 on each hanging bar 21 and 22 includes a first hanging slot 23 located on the upper portion of the hanging bar 21 and 22 and a second hanging slot 24 located on the lower portion of the hanging bar 21 and 22, and each hanging slot 23 and 24 engages to the corresponding hanging piece 5, that is, the hanging pieces 5 correspond to the hanging slots one by one.

Further, to facilitate the hanging slots to be hung on the corresponding hanging pieces 5, in this embodiment, each hanging slot 23 and 24 has a downward opening 23*b*, 24*b*. And, the first hanging slot 23, having a bent passage, is bent backward from the top to the down, and the opening 23*b* of the first hanging slot 23 is located on a rear edge of the hanging bars 21 and 22; and the second hanging slot 24, having a sloped passage, is sloped backward from the top to the down, and the opening 24*b* of the second hanging slot 24 is located on a bottom edge of the hanging bars 21 and 22. The opening 23*b*, 24*b* of each of the first hanging slot 23 and the second hanging slot 24 is bigger than the inner end 23*a*, 24*a* of the first hanging slot 23 and the second hanging slot 24, enabling the first hanging slot 23 and the second hanging slot 24 to be hung on the corresponding hanging pieces 5 more easily.

During the assembly of the panel mechanism, it is easy to hang the second hanging slot 24 on the corresponding hanging piece 5 first, and then hang the first hanging slot 23 on the corresponding hanging piece 5. Moreover, the first hanging slot 23 can limit the panel mechanism up and down to a certain extent through its bent passage, so that the panel mechanism can be limited in more excellent manner through the hanging slots and the hanging pieces 5. In this embodiment, the hanging pieces 5 are stepped screws fixed on the left and right side plates 3 and 4 respectively, which can make the hanging pieces 5 simple in structure and also can limit the panel 1 in more excellent manner through the hanging slots.

In addition, each hanging bar 21 and 22 has a fixing hole 25 respectively disposed at the upper end of the hanging bar 21 and 22, two fasteners 6 respectively pass through each fixing hole 25 to fix the hanging bar 21 and 22 to the left and right side plates 3 and 4 of the range hood. Further, each of the fixing holes 25 is arranged on the upper portion of each hanging bar 21 and 22, and located above the corresponding first hanging slot 23, and spaced away from the first hanging slot 23, so that mutual interference between the fasteners 6 and the corresponding hanging pieces 5 can be avoided, and the panel 1 can be fixed more firmly to the housing of the range hood.

From the above, in this embodiment, during its assembly, the panel mechanism is hung on the housing of the range hood through the hanging slots 23 and 24 and the hanging pieces 5, and the panel and the panel frame then is fixed on the housing by the fasteners 6.

During the disassembly of the panel mechanism, the panel mechanism can be removed from the hanging pieces 5 by simply unscrewing the fasteners 6, therefore it is easy for disassembly. When it is necessary to clean up the oil accumulated in the inner cavity of the range hood, the panel mechanism can be easily removed to expose the oil accumulated area to be cleaned up in the range hood, thus making it easy for users to clean up the oil accumulated in the range hood.

The invention claimed is:

1. A panel mechanism of a range hood, wherein the range hood comprises a left side plate, a right side plate, and a plurality of hanging pieces disposed on the left and right side plates, the panel mechanism comprising:

a panel having an inner side surface and a panel frame attached to the inner side surface of the panel;

wherein, the panel frame has a plurality of hanging slots disposed at a left end and a right end of the panel frame, each hanging slot engages one respective hanging piece of the plurality of hanging pieces and the panel frame is secured by the plurality of hanging pieces;

the panel frame has a left hanging bar and a right hanging bar which are vertical relative to the inner side surface of the panel, and distributed along the width direction of the panel, the plurality of hanging slots are distributed on the left hanging bar and the right hanging bar;

each hanging bar has an upper portion and a lower portion, the plurality of hanging slots on each hanging bar comprise a first hanging slot located on the upper portion of the respective hanging bar and a second hanging slot located on the lower portion of the respective hanging bar, and each hanging slot engages to the corresponding hanging piece;

each hanging slot has a downward opening; and the panel frame has two fixing holes respectively disposed at the left end and right end of the panel frame, and one fastener respectively passes through each fixing hole to fix the panel frame to the left and right side plates of the range hood.

2. The panel mechanism of claim 1, wherein each first hanging slot has a bent passage that bends backwards and downwardly, and an opening of each first hanging slot is located on a rear edge of the respective hanging bar;

and each second hanging slot has a sloped passage that slopes backward and downwardly, and an opening of each second hanging slot is located on a bottom edge of the respective hanging bar.

3. The panel mechanism of claim 2, wherein the bent passage of each first hanging slot and the sloped passage of each second hanging slot gradually narrows in width from their respective openings.

4. The panel mechanism of claim 1, wherein each of the two fixing holes is arranged on the upper portion of each hanging bar, and located above and spaced apart from the corresponding first hanging slot.

5. The panel mechanism of claim 1, wherein the hanging pieces are stepped screws fixed on the left and right side plates respectively.

* * * * *